US007204709B2

(12) United States Patent
Justice

(10) Patent No.: US 7,204,709 B2
(45) Date of Patent: Apr. 17, 2007

(54) CABLE CONNECTOR FOR WELDER OR WIRE FEEDER

(75) Inventor: Kenneth L. Justice, Wickliffe, OH (US)

(73) Assignee: Lincoln Global, Inc., City of Industry, CA (US)

( * ) Notice: Subject to any disclaimer, the term of this patent is extended or adjusted under 35 U.S.C. 154(b) by 583 days.

(21) Appl. No.: 10/619,764

(22) Filed: Jul. 15, 2003

(65) Prior Publication Data

US 2005/0014410 A1 Jan. 20, 2005

(51) Int. Cl.
*H01R 13/62* (2006.01)

(52) U.S. Cl. ..... 439/306

(58) Field of Classification Search ..... 439/306–309, 439/320–323

See application file for complete search history.

(56) References Cited

U.S. PATENT DOCUMENTS 2,498,589 A * 2/1950 Steinke ..... 439/322
2,605,315 A * 7/1952 Hargett ..... 439/275
3,680,034 A * 7/1972 Chow et al. ..... 439/289
3,824,526 A * 7/1974 Glover ..... 439/272
4,090,759 A * 5/1978 Herrmann, Jr. ..... 439/281
4,466,610 A * 8/1984 Israel ..... 482/91
5,087,209 A * 2/1992 Faucher ..... 439/320
5,308,259 A * 5/1994 Liao ..... 439/320
5,439,386 A * 8/1995 Ellis et al. ..... 439/322
5,454,728 A * 10/1995 Jack ..... 439/277
6,358,076 B1 * 3/2002 Haag ..... 439/320

* cited by examiner

*Primary Examiner*—Ross Gushi
(74) *Attorney, Agent, or Firm*—Fay Sharpe LLP; Brian E. Turung

(57) ABSTRACT

A cable coupler on a welder housing or wire feeder for conveniently connecting a cable to said welding housing or wire feeder. The cable coupler includes a coupler having a coupling jacket which contains an electrical coupling cavity having one or more one electrical connectors positioned therein and a coupling sleeve rotatably positioned at least partially about the coupling jacket. The coupling jacket is designed to be at least partially telescopically received in a cable connection sleeve of the cable. The electrical connector is designed to be electrically connected to a corresponding electrical connector in the cable connection sleeve when the coupling jacket is at least partially telescopically received in the cable connection sleeve. The coupling sleeve includes a joining cavity having a connection member designed to at least partially engage an outer surface of the cable connection sleeve after the electrical coupling cavity is at least partially telescopically inserted in the cable connection sleeve and the electrical connector in the coupling cavity is at least partially electrically connected to the corresponding electrical connector in the cable connection sleeve.

49 Claims, 9 Drawing Sheets

CABLE CONNECTOR FOR WELDER OR WIRE FEEDER

The present invention relates to the art of welding, and more particularly, to connectors used to connect various types of cables to welding housings and wire feeders.

BACKGROUND OF THE INVENTION

Cable connectors are commonly used to connect various components to electric arc welders and other types of welders. Commonly, a wire feeder, which is used in association with a welder is electrically connected to the welder by an electric cable. The electrical cable is used to transmit power and various other types of information through the multiple electrical connections housed by the cable.

One common type of cable connector is illustrated in FIGS. 1–3. In this typical prior art arrangement, a mounting plate which houses a cable coupler is connected to the side of a welder or wire feeder. Positioned within the cavity of the cable coupler is a plurality of male electrical connectors. An electrical cable is connected to this coupler by the use of a cable connector mounted on the end of the electrical cable. The cable connector includes a plurality of female connectors which are designed to receive the male electrical connectors formed in the coupler mounted on the side of the welder or wire feeder. These prior art couplers were time consuming to use since it was difficult to properly connect and disconnect the cable from the welder or wire feeder. The cable connector connected to the cable was initially oriented and slightly inserted abut a portion of the coupler mounted on the side of the welder or wire feeder. Once the cable connector was properly oriented with respect to the coupler, the cable connector was continuously pushed into the coupler while a coupling sleeve on the coupler was rotated thereby threading the cable connector onto the coupler. When done properly, this procedure usually took several minutes to complete the connection. When the cable was to disconnected from a welder or wire feeder, the coupling sleeve once again had to be rotated while the cable connector was simultaneously being pulled from the coupler. Once again, this procedure was time consuming to complete.

In view of the deficiencies in past designs for cable connectors used to connect cables to welders and/or wire feeders, there is a need for an improved connector that can be quickly connected and detached from a welder or wire feeder in a simple and effective manner.

SUMMARY OF THE INVENTION

The present invention is directed to a cable connector which overcomes the deficiencies of past cable connectors for welders and/or wire feeders. The present invention is directed to a connector which is used to connect an electrical cable to a welder housing and/or wire feeder housing; however, the invention has broader applications and can be used to easily, quickly, and conveniently connect a variety of electrical and non-electrical cables, pipes, tubing, and there alike for use in a wide variety of applications.

In accordance with the present invention, there is provided a cable coupler which is connected to the side of a welder and/or wire feeder and is designed to quickly, easily, and conveniently connect and disconnect an electrical cable to or from the welder or wire/feeder. The cable coupler on the housing of the welder and/or wire feeder is designed such that it can connect and/or disconnect standard cable connectors to the welder or wire feeder without any modification to existing electrical cables or the associated cable connector on the electrical cable. As, can be appreciated, the cable coupler can be designed to be used with particular types, of cable connectors for particular types of electrical cables that are used in association with a welder and/or wire feeder. The cable coupler is designed to allow a cable connector on an electrical cable to be substantially inserted onto the cable connector prior to a connector member on the cable coupler engaging the cable connector to thereby secure the cable connector to the cable coupler. In prior designs, the prior art cable coupler only allowed the cable connector on the cable to be positioned essentially on the face of the cable coupler and a connecting member was then immediately engaged with the cable connector to both secure the cable connector to the cable coupler and to cause the male and female electrical connectors which were associated with the cable coupler and cable connector to subsequently engage with one another to form an electrical connection. Contrary to this prior art cable coupler design, the cable coupler of the present invention allows the cable connector on an electrical cable to be substantially inserted onto the cable coupler prior to a connector on the cable coupler having to engage the cable connector to secure the cable connector to the cable coupler. In one embodiment of the present invention, the cable connector of the electrical cable can be inserted on the cable coupler mounted on the welder and/or wire feeder such that the male and female electrical connectors of the cable coupler and cable connector form an electrical connection prior to the connector member on the cable connector engaging and securing the cable connector to the cable coupler. In one aspect of this embodiment, the cable connector is insertable onto the cable connector such that the male and female electrical connectors on the cable coupler and cable connector are over 50% fully connected with one another, and typically over 60%, and more typically over 70%, and even more typically over 80%, and still even more typically over 90%. In another and/or alternative embodiment of the present invention, the cable coupler is designed such that the connector member on the cable coupler can be disengaged from the cable connector while the cable connector is still substantially connected to the cable coupler. In prior art cable coupler designs, when the connection member was unthreaded from the cable connector on an electrical cable, the cable connector was essentially disengaged at that point from the cable coupler. The cable coupler of the present invention does not cause the cable connector to substantially disengage from the cable coupler after the connecting mechanism on the cable coupler has been disengaged from the cable connector. In one aspect of this embodiment, the male and female electrical connectors on the cable coupler and cable connector are over 50% still fully engaged once the connector member on the cable connecter is fully disengaged from the cable connector, and typically at least 60%, more typically at least 70%, even more typically at least 80%, and still more typically at least 90%.

In accordance with another and/or alternative aspect of the present invention, the cable coupler includes a coupling sleeve that is designed to move at least partially axially along the length of the cable coupler and to engage the cable connector when at least a majority of the cable connector is inserted onto the cable coupler. The coupling sleeve includes a connecting member which is designed to engage with a connecting member on the cable connector to thereby at least partially secure the cable connector to the cable coupler. Many types of connection members can be used to at least partially secure the cable connector to the cable coupler. In one embodiment, the connector member is in the form of at least one thread on the cable coupler which is designed to mate with a corresponding thread on a portion of the outer surface of the cable connector of the electrical cable. In another and/or alternative embodiment, the coupling sleeve includes a joining cavity wherein the connection member is at least partially inserted therein. The joining cavity is designed to at least partially telescopically receive a portion of the cable connector and to thereafter secure the cable connector to the cable coupler by the use of the connection member that is at least partially located in the joining cavity. In still another and/or alternative embodiment of the present invention, the coupling sleeve includes a joining cavity having a beveled surface that is adapted to facilitate in at least partially guiding the coupling sleeve about a portion of the cable connector to facilitate in the connecting of the cable connector to the cable coupler. When a beveled surface is used in the adjoining cavity, the connecting member located in the joining cavity is typically positioned rearwardly of this beveled surface.

In accordance with still another and/or alternative aspect of the present invention, the coupling sleeve on the cable coupler has a design which facilitates in the ease of rotation of the coupling sleeve on the cable coupler to thereby facilitate in the connecting and disconnecting of the electrical cable to and from the cable coupler. In one embodiment of the invention, the coupling sleeve includes at least one gripping arrangement that is designed to facilitate in the ease of gripping the coupling sleeve. In one aspect of the invention, the gripping element is in the form of at least one node, which protrudes outwardly from the center of the coupling sleeve. In one non-limiting design, there is provided a plurality of nodes on the coupling sleeve arranged to form a star-like configuration. As can be appreciated, many different arrangements of the nodes and the orientation of the nodes with respect to one another can be used to facilitate in the gripping of the coupling sleeve.

In yet another and/or alternative aspect of the present invention, the cable coupler includes at least one orientation member which is used to properly orient the cable connector relative to the cable coupler prior to the cable connector being inserted onto the cable coupler. Typically, the cable coupler and the cable connector include a plurality of electrical connections. Each of these electrical connections typically has a particular function (e.g. power conveyance, control signal conveyance, electrical grounding, etc.). As such, it is important that the proper connections are made between the cable connector and the cable coupler. The guide member on the cable coupler is designed to require the cable connector to be properly oriented such that the appropriate electrical connections on the cable coupler and cable connector are electrically connected together when the cable coupler is secured to the cable coupler. The arrangement used to ensure that the cable connector and cable coupler are properly oriented together can take on a variety of forms such as, but not limited to, certain geometric configurations of the cable connector and/or cable coupler, visual markings on the cable connector and/or cable coupler, particular configurations of the electrical connectors on the cable coupler and/or cable connector, the use of differing size electrical connectors on the cable coupler and/or cable connector, etc. In one embodiment of the invention, the cable coupler includes a guide slot which is designed to receive a guide nub or tooth on the cable connector. This slot tooth arrangement ensures the proper orientation of the cable connector to the cable coupler when the cable connector is inserted onto the cable coupler.

It is a principal object of the present invention to provide a cable coupler which easily and conveniently connects and/or disconnects a cable connector on an electrical cable to a welder or wire feeder.

It is another and/or alternative object of the present invention to provide a cable coupler that reduces the time necessary to connect and/or disconnect a cable connector to a welder and/or wire feeder.

Still another and/or alternative object of the present invention is the provision of a cable coupler which enables at least a majority of the cable connector to be inserted onto the cable coupler prior to the cable connector being secured to the cable coupler.

Still yet another and/or alternative object of the present invention is the provision of a cable connector which includes a coupling sleeve having a beveled surface to facilitate in the connection of the cable connector to the cable coupler.

Still yet a further and/or alternative object of the present invention is the provision of a cable coupler which includes a guide member to ensure the proper orientation of the cable connector on the cable coupler.

A further and/or alternative object of the present invention is the provision of a cable coupler which includes a coupling sleeve having gripping elements to facilitate in the connecting and/or disconnecting of the cable connector to the cable coupler.

Still a further and/or alternative object of the present invention is the provision of a cable coupler which forms an electrical connection with a cable connector of an electric cable in a quick, easy, and convenient manner.

Yet a further and/or alternative object of the present invention is the provision of a cable connector which is designed to connect and disconnect standard size cable connector without the need for special adaptors to facilitate in the connection and/or disconnection of the cable connector to and from the cable coupler.

These and other objects and advantages will become apparent from the discussion of the distinction between the invention and the prior art and when considering the preferred embodiments as shown in the accompanying drawings.

BRIEF DESCRIPTION OF THE DRAWINGS

The foregoing objects, and others, will in part be obvious and in part pointed out more fully hereinafter in conjunction with the written description of the preferred embodiments of the invention illustrated in the accompanying drawings in which.

DESCRIPTION OF PREFERRED EMBODIMENTS

Figure 1:
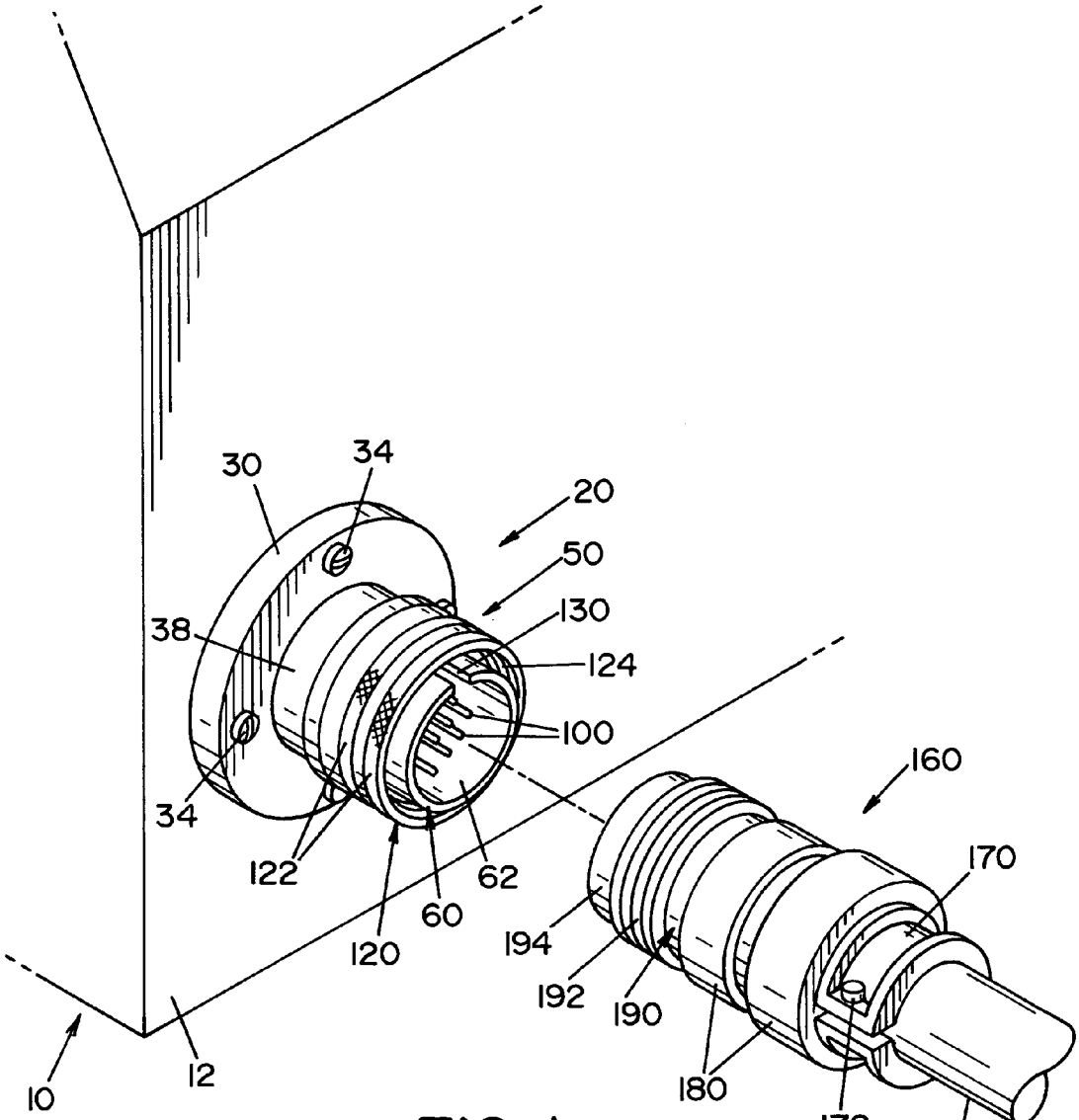
FIG. 1 (PRIOR ART)
FIG. 1 is a perspective view of a prior art coupler on the side of a welder or wire feeder which electric coupler is designed to connect a standard prior art cable connector.
Figure 2:
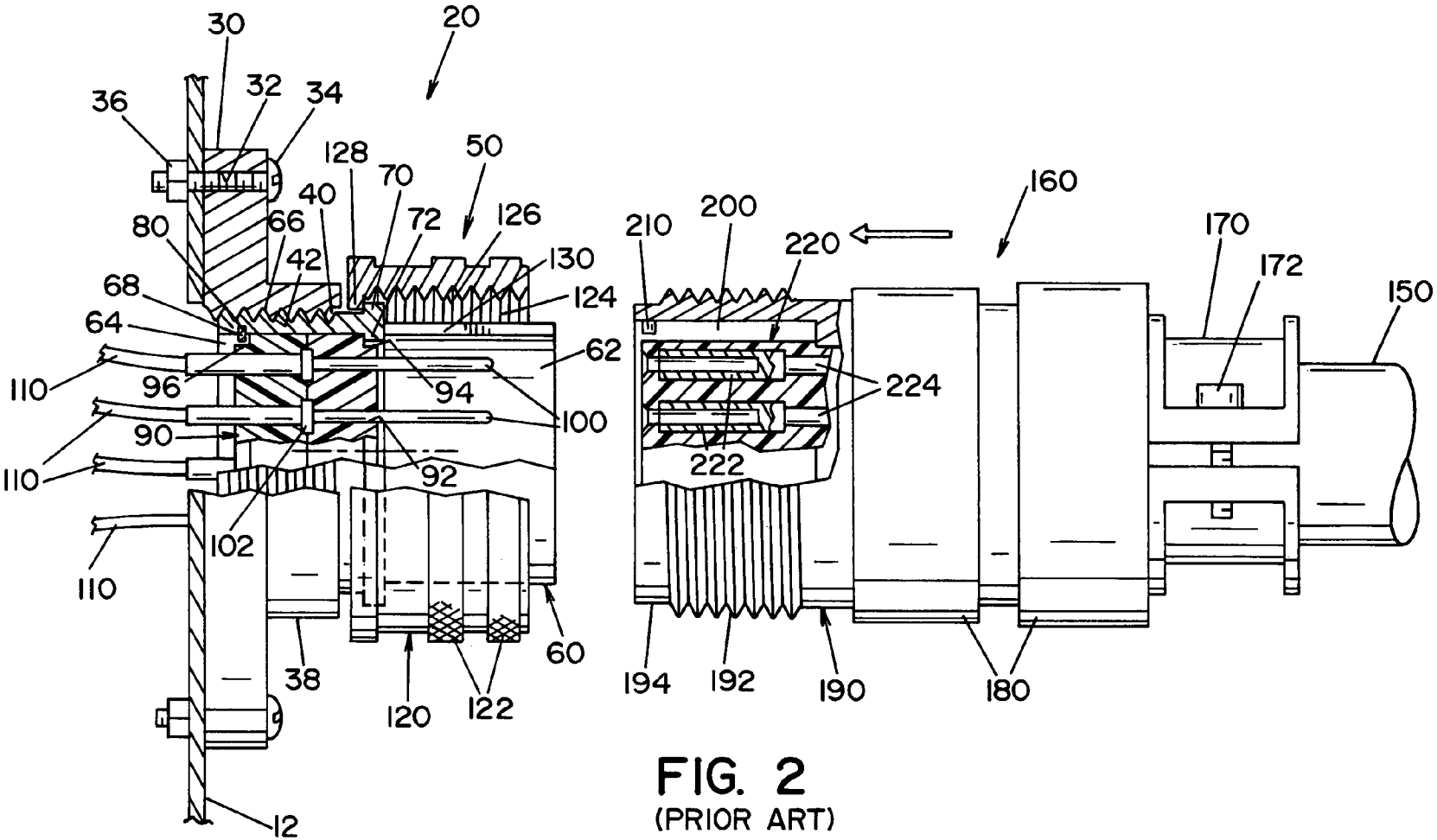
FIG. 2 (PRIOR ART)
FIG. 2 is a partial sectional side view of the prior art cable coupler and prior art cable connector of FIG. 1.
Figure 3:
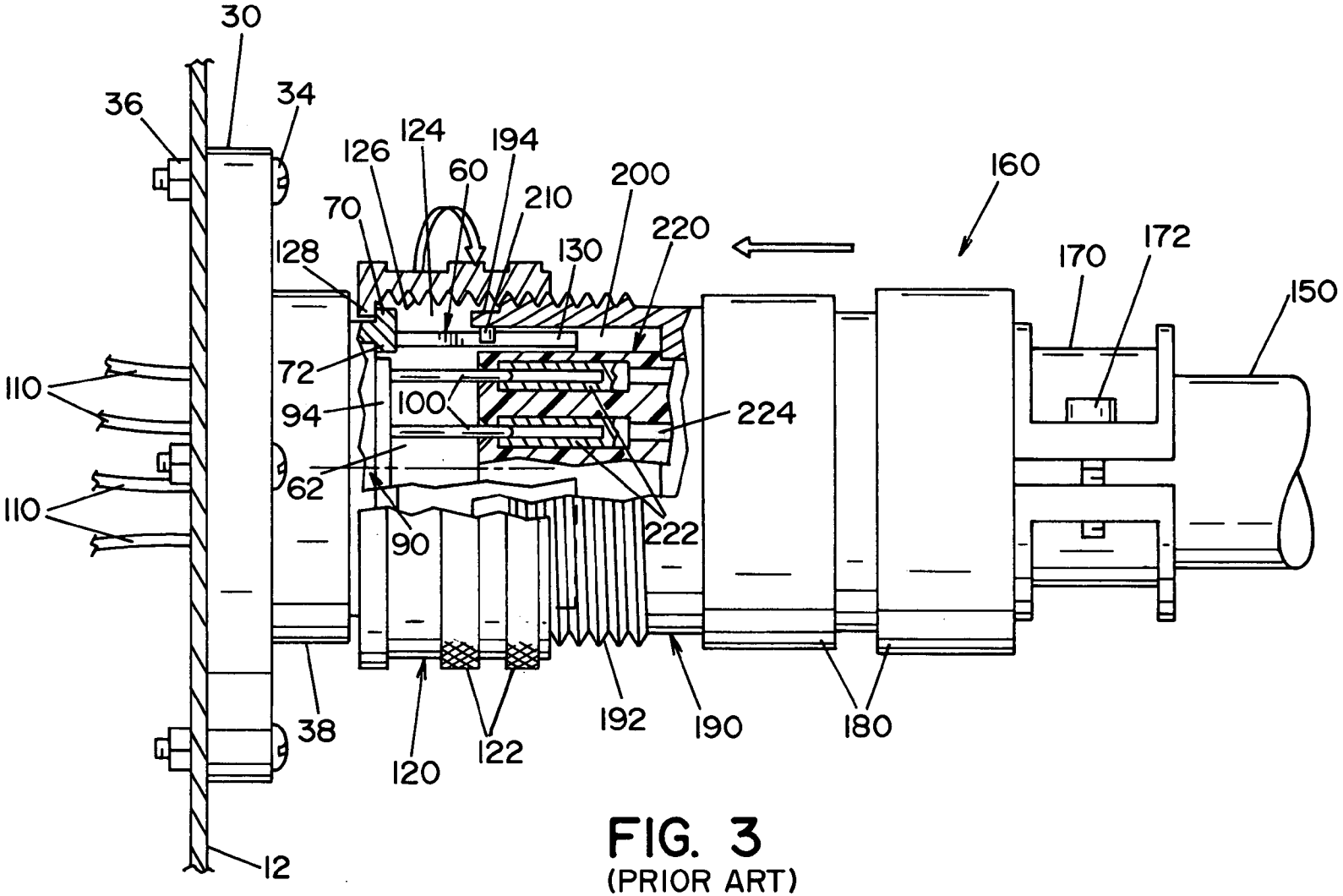
FIG. 3 (PRIOR ART)
FIG. 3 is a partial sectional view of the prior art coupler and prior art cable connector being connected together.
Figure 4:
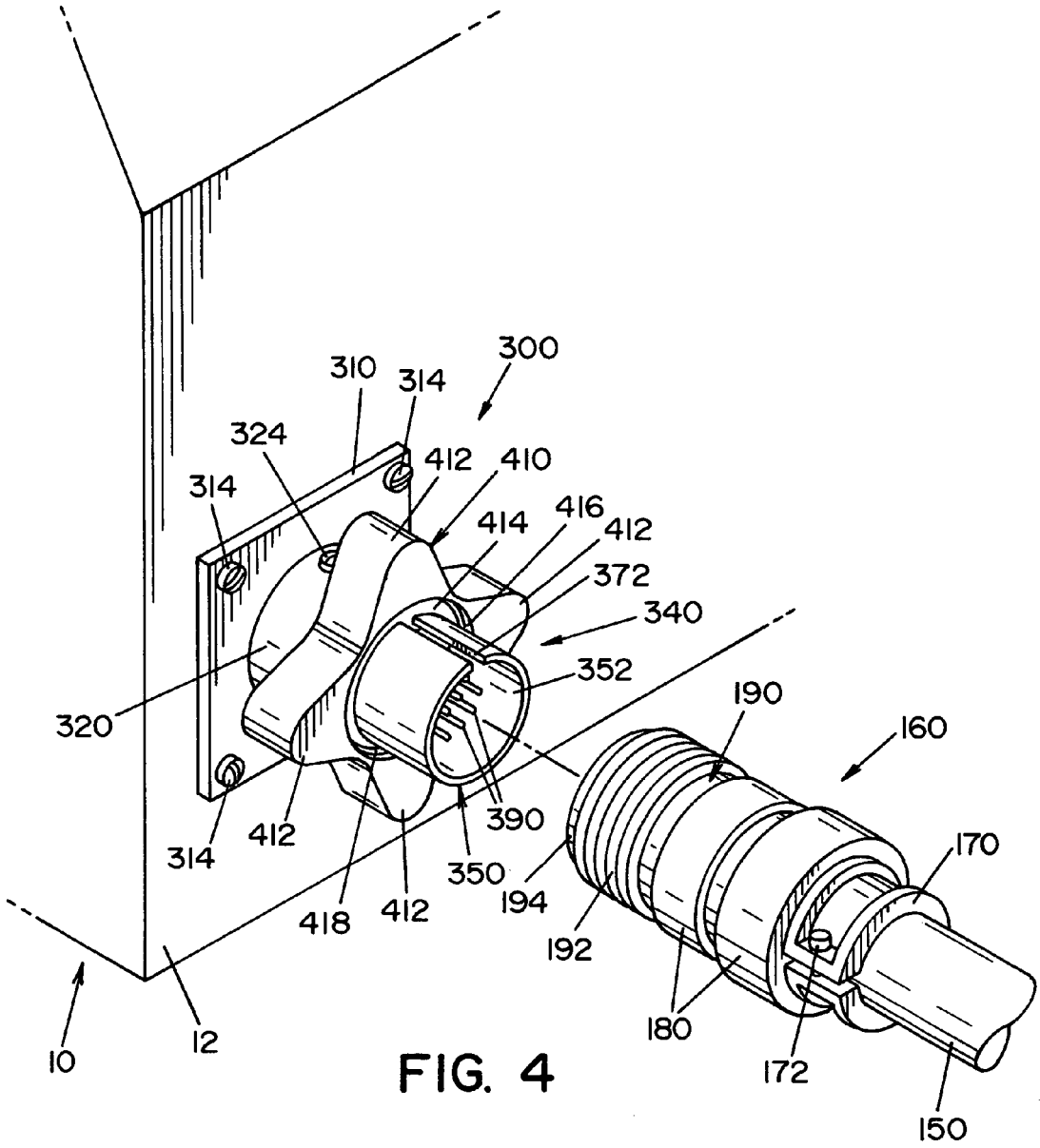
FIG. 4 is a perspective view of the cable connector of the present invention used to connect a standard prior art cable connector to a welder or wire feeder.

Referring now in greater detail to the drawings, wherein the showings are for the purpose of illustrating preferred embodiments of the invention only and not for the purpose of limiting the invention, FIGS. 1–3 illustrate a standard prior art cable coupler 20 which is secured to the side or front panel 12 of a welder or wire feeder 10. Cable coupler 20 includes a mount plate 30 having four openings 32 that are designed to receive four bolts 34 used to secure the mount plate 30 to the side or front panel 12 by the use of nuts 36. As best illustrated in FIG. 2, mount plate 30 includes a plate flange 38 and a plate cavity 40 therethrough which plate cavity includes a thread 42. Plate cavity 40 is designed to threadedly receive a coupler 50. Coupler 50 includes a coupling jacket 60 having a coupling cavity 62 and a connector cavity 64. The rear outer surface of coupler 50 includes a thread 66 designed to threadably secure coupler 50 within plate cavity 40 of mount plate 30 by engaging the thread 42 in plate cavity 40. An electrical plug 90 is positioned in connector cavity 64. Electrical plug 90 includes a front groove and a rear groove which are used to secure the electrical plug within the connector cavity. Front groove 94 receives a lower retention member 72 to prevent the electrical plug from moving into the coupling cavity of coupling jacket 60. Rear groove 96 receives a retention ring 80 positioned in a ring groove 68 of the coupling jacket. Retention ring 80 prevents the electrical plug from moving rearwardly out of connector cavity 64. Electrical plug 90 includes a plurality of connector slots 92 designed to receive male electrical connectors 100. Each of the male connectors include a connector rib 102 designed to secure the electrical connectors and the respective connector slots of the electrical plug. The front end of the male connectors 100 extend forwardly through the electrical plug and at least partially into coupling cavity 62 of coupling jacket 60. Connected to the rear of each of the electrical connectors 100 is a wire 110 which is connected to one or more components within the welder or wire feeder 10. Coupler 50 also includes a coupling sleeve 120 which is designed to at least partially encircle coupling cavity 62. Coupling sleeve 120 includes two gripping rings 122 on the outer surface of the coupling sleeve to facilitate in the rotation of the coupling sleeve about the central axis of the coupler 50. The coupling sleeve includes a joining cavity 124 having a thread 126. At the rearward end of coupling sleeve 120 there is provided a stop flange 128 which is designed to engage upper retention member 70 of coupling jacket 60 to thereby limit the forward movement of coupling sleeve 120 along the longitudinal axis of the coupler. The front face of plate flange 38 functions as a rearward stop to coupling sleeve 120 to thereby limit the backward movement of the coupling sleeve along the longitudinal axis of coupler 50.

The prior art cable connector 160 as illustrated in FIGS. 1–3 is connected to an electrical cable 150. Cable connector 160 includes a cable clamp positioned at the rearward end of the cable connector. A tightening screw 172 is used to tightened clamp 170 about electric cable 150, thereby securing cable connector 160 to electrical cable 150. Cable connector 160 also includes two gripping rings 180 which are used to facilitate in the handling and orienting of the cable connector when connecting the cable connector to the cable coupler 20. Positioned at the front end of cable connector 160 is a connection sleeve 190 which includes a threaded outer surface 192 and a non-threaded front edge surface 194. Connection sleeve 190 includes a connection cavity 200 wherein a connection plug 220 is located therein. Connection plug 220 includes a plurality of female connectors 222 which each include a wire 224 connected at the end thereof. Female connectors 222 are designed to telescopically receive a portion of male electrical connectors 100 located in coupling cavity 62 of coupler 50. Positioned on the interior surface near the front end of connection cavity 200 is a guide tooth 210. Guide tooth 210 is designed to engage a guide slot 130 located on coupling jacket 60. The guide tooth 210 and the guide slot 130 are used to properly orient cable connector 160 with respect to coupler 20 so as to provide the proper electrical connections between the two components.

As can be visualized from reference to FIG. 2, cable connector 160 can only be partially inserted onto coupler 50 prior to threads 192 on connection sleeve 190 engaging threads 126 of coupling sleeve 120 of coupler 50. Typically at the point of engagement of threads 192 with threads 126, guide tooth 210 has just begun to slide into guide slot 130 and the ends of male electrical connectors 100 are slightly spaced from female connectors 222. The electrical connection between cable connector 160 and cable coupler 120 is formed and completed by simultaneously pushing cable connector 160 into coupler 50 while rotating coupling sleeve 120 to thereby thread connection sleeve 190 into joining cavity 124 as illustrated in FIG. 3. The procedure of constantly pushing the cable connector 160 into coupler 50 while simultaneously rotating coupler sleeve 120 to complete the connection between the cable connector and coupler is time consuming and can be difficult. The procedure of constantly pulling cable connector 160 while simultaneously rotating coupler sleeve 120 to remove the cable connector from coupler 120 is also time consuming and can, at times, be difficult. Indeed, it is not unusual for it to take several minutes to connect or disconnect the electrical cable 150 from welder or wire feeder 10.

Figure 9:
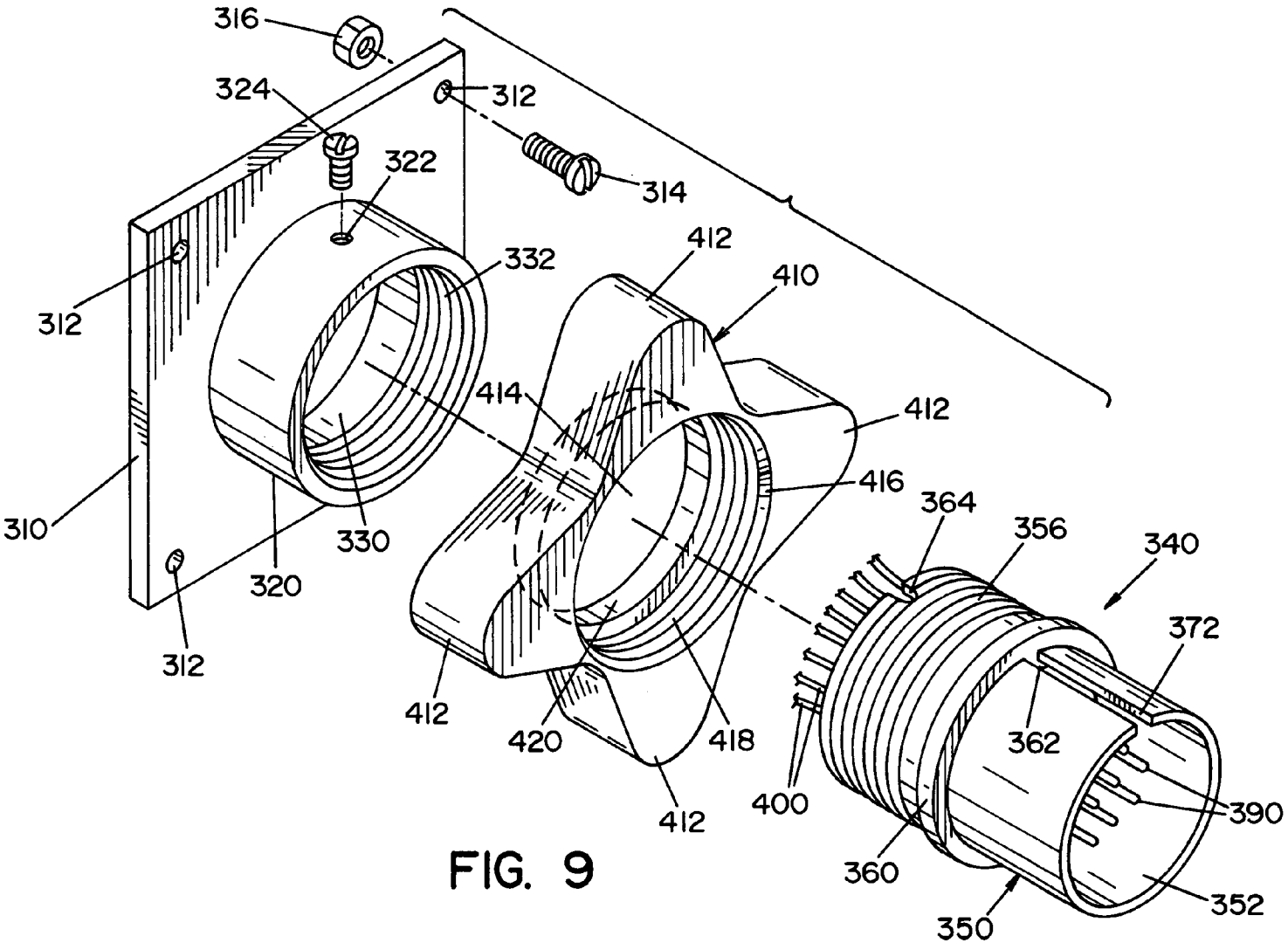
FIG. 9 is an exploded perspective view of the cable coupler of the present invention.

Referring now to FIGS. 4–9, there is illustrated the improved cable coupler 300 in accordance with the present invention. As best illustrated in FIG. 9, cable coupler 300 includes a mount plate 310 having a substantially square-shaped configuration. Positioned near each one of the four corners of the mount plate is an opening 312 which is configured to receive a bolt or screw 314. Bolt or screw 314 is insertable through opening 312 and through a corresponding opening 14 in the side or front panel of welder or wire feeder 10. A nut 316 is threaded on the end of bolt or screw 314 thereby securing mount plate 310 to the side or front panel of welder or wire feeder 10. Mount plate 310 also includes a flange 320 which extends outwardly from the top surface of mount plate 310. A cavity 330 extends through flange 320 and the back side of mount plate 310. A thread 332 is positioned partially in cavity 330. Through the outer surface of flange 320 is an opening 322 which is designed to threadably receive lock bolt or screw 324. Although the dimensions of the mount plate and other components of cable connector 300 are not limited and are typically based upon the configuration of the welder or wire feeder to be connected thereto and also the type of cable connector 160 to be connected to cable coupler 300, the relative dimensions of certain components of the cable coupler are important for the successful operation of the cable coupler. As such, one particular set of dimensions for the cable coupler components will be referred to when describing the components of the cable coupler; however, it will be appreciated that these specific dimensions are only exemplary. For example, thread 332 in cavity 330 has an outside diameter of about 1.25 inches and an inside diameter of about 1.19 inches. The threads travel at least half the longitudinal length of flange 320; however, the threads can extend fully through cavity 330 or extend some lesser distance through cavity 330. The thickness of mount plate 310 is about 1/10 inch and the length of flange 320 is about ½ inch. Opening 312 is about 0.35 inch to receive a threaded screw having similar dimensions. The relationship of dimensions of thread 332 is of importance to the other components of cable coupler 300, and the other dimensions of mount plate 310 are of significantly lesser importance.

Figure 5:
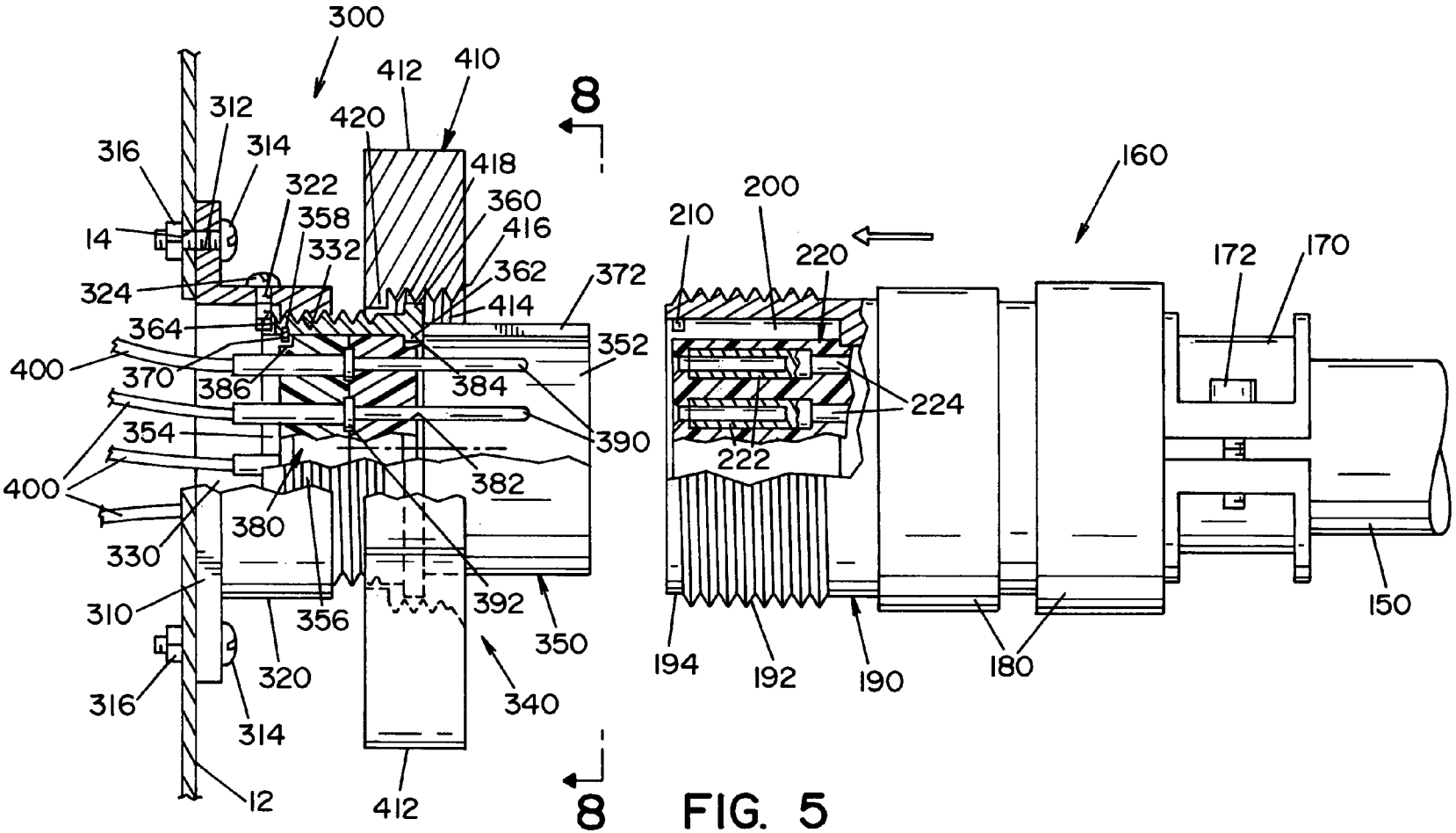
FIG. 5 is a partial sectional side view of the cable coupler of the present invention and the prior art cable connector as illustrated in FIG. 4.
Figure 6:
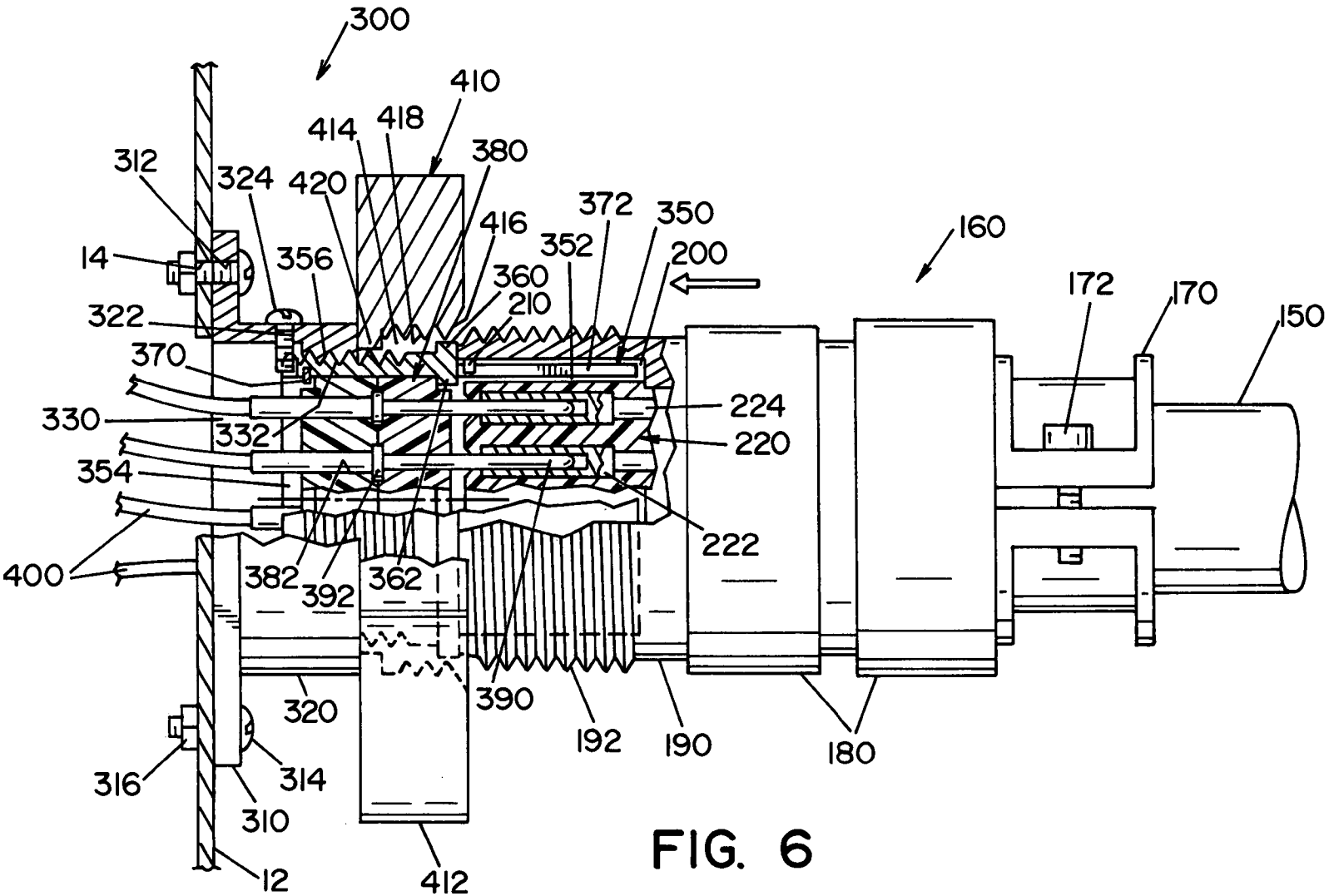
FIG. 6 is a partial sectional side view of the prior art cable connector being inserted onto the cable coupler of the present invention.
Figure 7:
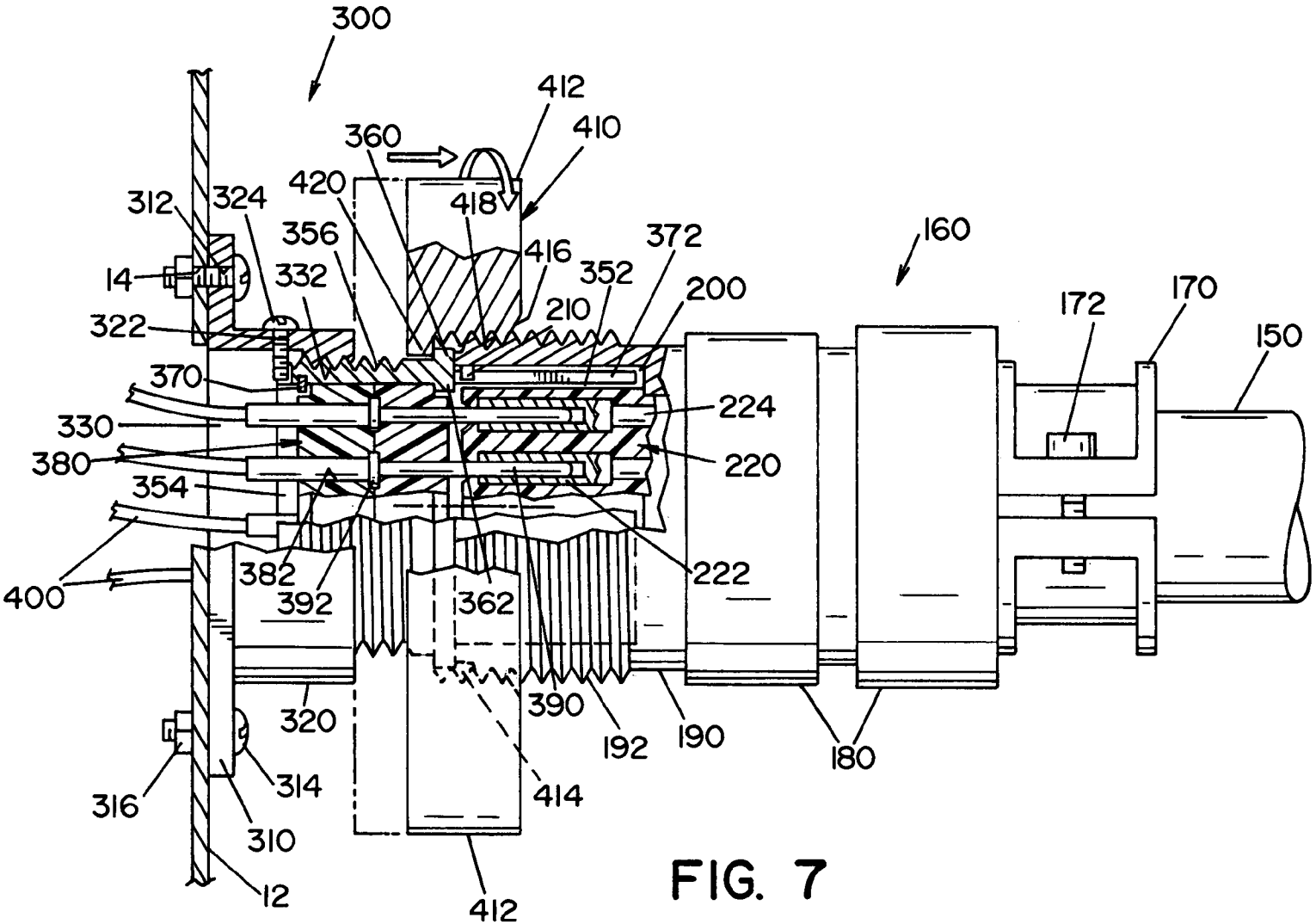
FIG. 7 is a partial sectional side view of the prior art cable connector being secured to the cable coupler of the present invention after it has been inserted on the cable coupler as illustrated in FIG. 6.
Figure 8:
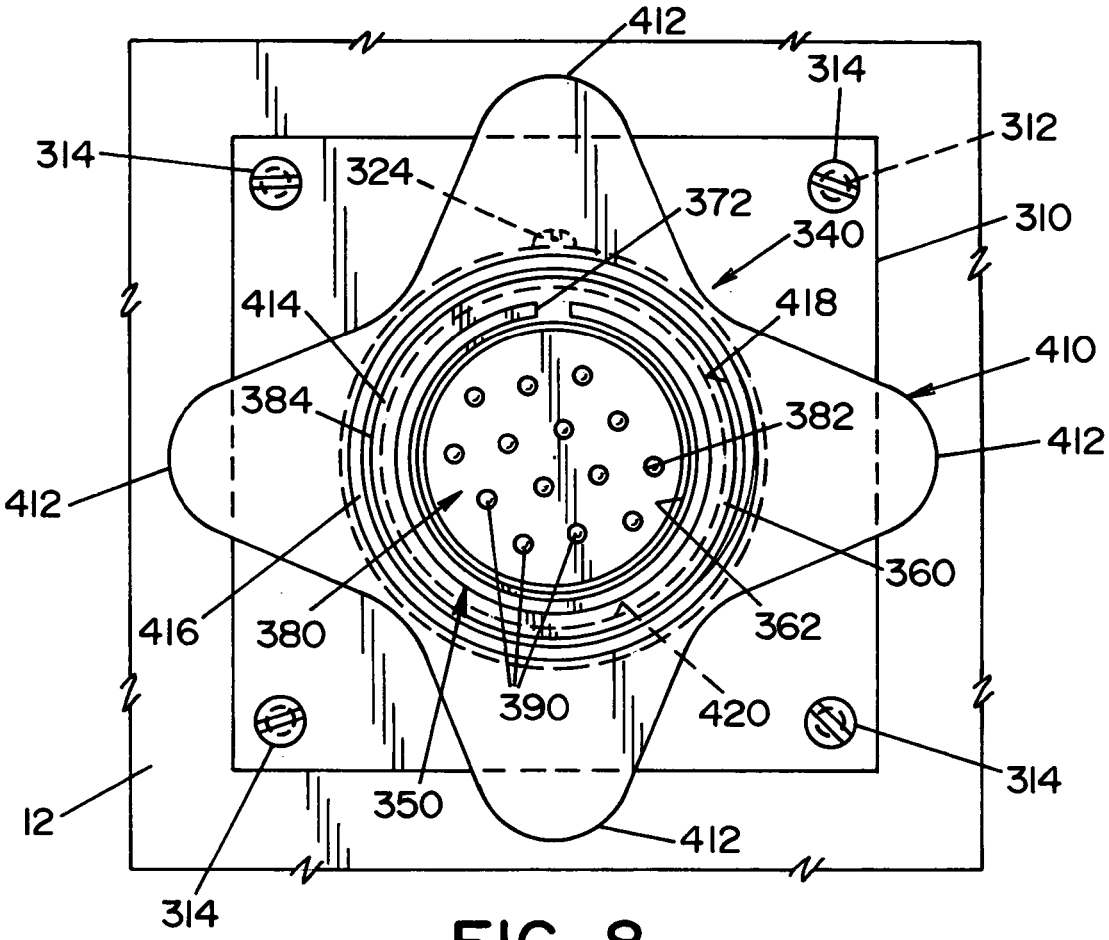
FIG. 8 is an elevational view along line 8—8 of FIG. 5.

Threads 332 in the cavity of mount plate 310 are designed to threadably receive the threaded rear outer surface 356 of coupler 340. Coupler 340 includes a coupler jacket 350 having a threaded rear outer surface 356 and two cavities. The front part of coupling jacket 350 includes a coupling cavity 352 and the rear portion of coupling jacket 350 includes a connector cavity 354. Positioned about the outer circumference of coupler jacket 350 and near the center of the longitudinal length of coupling jacket 350 is an upper retention member 360. Upper retention member 360 has a greater diameter than the outer diameter of threads 356. Positioned between the front edge of coupler jacket 350 and terminating at upper retention member 360 is a guide slot 372. As best illustrated in FIGS. 5–7, an electrical plug 380 is insertably positioned in connector cavity 354. Electrical plug 380 includes a plurality of slots 382 which are designed to receive a male electrical connector 390. Each male connector 390 includes a connector rib 392 designed to secure each male connector 390 in position relative to electrical plug 380. Electrical plug 380 also includes a front groove 384 and a rear groove 386. Front groove 384 is designed to engage lower retention member 362 positioned at the front end interior surface of connector cavity 354. Lower retention member 362 prevents electrical plug 380 from moving into coupling cavity 352 of coupling jacket 350. Rear groove 386 is designed to receive a retention ring 370 which is positioned in a ring groove 358 near the front end interior surface of connector cavity 354. Retention ring 370 prevents electrical plug 380 from moving rearwardly out of connector cavity 354. As can be ascertained from FIGS. 5–9, threads 356 on coupling jacket 350 are designed to be threadably received by threads 332 of cavity 330 in mount plate 310. Coupling jacket 350 is threaded into cavity 330 until lock slot 364 on coupling jacket 350 is aligned with opening 322 in flange 320. Once lock slot 364 is aligned with opening 322, a screw or bolt 324 is threadably inserted into opening 322 until the end of the bolt or screw engages or is inserted at least partially into lock slot 364. The positioning of the end of screw or bolt 324 into lock slot 364 prevents further rotation of coupling jacket 350 in cavity 330 thereby locking coupling jacket 350 in cavity 330 of mount plate 310. The opening in the rear of mount plate 310 allows for wires 400 from the interior of welder or wire feeder 10 to be connected to the ends of male electrical connectors 390.

As best illustrated in FIG. 5, upper retention member 360 is spaced from the front edge of flange 320 after coupling jacket 350 is locked in cavity 330 of mount plate 310. This space allows for limited longitudinal movement of coupling sleeve 410 along the longitudinal axis of coupling jacket 350. As best shown in FIG. 9, coupling sleeve 410 includes four gripping nodes 412 which are symmetrically oriented about the coupling sleeve thereby forming a generally star-shaped configuration. The gripping nodes are used to facilitate in the rotation of coupling sleeve 410 about the longitudinal axis of coupling jacket 350 as will be further described below. Positioned essentially through coupling sleeve 410 is a joining cavity 414. The front end of joining cavity 414 includes a beveled surface 416 and a threaded surface rearwardly positioned of beveled surface 416. Positioned at the back end of joining cavity 414 is a stop flange 420. As best illustrated in FIG. 5, the diameter of the opening defined by stop flange 420 is slightly less than the minimum diameter of threads 418 in joining cavity 414. Furthermore, the maximum diameter of thread 418 is less than the maximum diameter of beveled surface 416. As shown in FIG. 5, the diameter of joining cavity 414 in the region of stop flange 420 is larger than the maximum diameter of threads 356 on coupling jacket 350. However, the diameter of upper retention member 360 on coupling jacket 350 is greater than the diameter of joining cavity 414 within the region of the stop flange 420. As such, when coupling jacket 350 is locked into cavity 330 of mount plate 310, coupling sleeve 410 has limited movement between the front face of flange 320 of mount plate 310 and the back end surface of upper retention member 360. As shown in FIG. 5, the minimum diameter of threads 418 is greater than the diameter of upper retention member 360 thus allowing the limited longitudinal movement of coupling sleeve 410 along the longitudinal axis of coupling jacket 350. For purposes of example, the minimum diameter of threads 356 is about 1.065 inches, the diameter of upper retention member 360 is about 1.12 inches, and the diameter of the outer surface of connector cavity 354 is about 1 inch. With reference to coupling sleeve 410, the diameter of joining cavity 414 in the region of stop flange 420 is about 1.13 inches, the minimum diameter of threads 418 in joining cavity 414 is about 1.125 inches, and the maximum diameter of beveled surface 416 is about 1.3 inches. These relative dimensions of the components of coupler 340 and coupler sleeve 410 are illustrated in FIGS. 5–7.

As illustrated in FIGS. 5–7, the diameter of the outer portion of coupling cavity 352 is selected so as to be telescopically received into connection cavity 200 of cable connector 160. Guide tooth 210 located on the front interior surface of connector cavity 210 is designed to be received by guide slot 372 of coupling jacket 350 when the front portion of coupling jacket 350 is telescopically received into connection cavity 200. Guide slot 372 and guide tooth 210 ensure that cable connector 160 is properly oriented with coupler 340 such that the front portion of male connectors 390 located in the interior of connector cavity 354 are properly received in the corresponding female connectors 222 located in connection cavity 200 of cable connector 160.

The operation of cable connector 300 will now be briefly described. Referring now to FIG. 5, when cable connector 160 is to be connected to cable coupler 300, cable connecter 160 is initially oriented such that guide tooth 210 in connection cavity 200 is aligned with guide slot 372 of coupler jacket 350. Once guide tooth 210 is properly aligned with guide slot 372, thereby ensuring proper orientation of the cable connector 160 relative to cable coupler 300, cable connector 160 is inserted about coupler cavity 352 of coupling jacket 350 until front edge of cable connector 160 engages with the front face of upper retention member 360 as illustrated in FIG. 6. As shown in FIG. 6, the front ends of male connectors 390 are substantially fully positioned in the corresponding female connectors 222 of cable connector 160 thereby completing the electrical connection between cable connector 160 and cable coupler 300. Cable connector 160 is then secured on coupling jacket 350 by moving coupler sleeve 410 forwardly until threads 418 engage threads 192 of cable connector 160. The beveled surface 416 on the front portion of joining cavity 414 facilitates in the orientation of joining cavity 414 relative to threads 192. Once threads 192 and 418 engage, coupling sleeve 410 is rotated as indicated by the arrow in FIG. 7 to thread coupling sleeve 410 onto cable connector 160. As coupling sleeve 410 is threaded onto cable connector 160, coupling sleeve 410 moves forwardly along the longitudinal axis of coupling jacket 350 as indicated by the arrow until the front surface of stop flange 420 engages the back surface of upper retention member 360, thus completing the coupling of cable connector 160 to cable coupler 300. As described above, joining of cable connector 160 to cable coupler 300 is significantly quicker and easier than the connecting of coupler 50 to cable connector 160 as illustrated in FIGS. 1–3. As illustrated in FIGS. 5–7, cable connecter 160 is quickly and easily inserted onto coupling jacket 350 of coupler 340 and then coupling sleeve 410 is moved into engagement with and rotated about threads 192 on cable connector 160 to quickly complete the securing of cable connector 160 to cable coupler 300.

Cable connector 160 can be quickly disengaged from cable coupler 300 by reversing the procedure as described above.

These and other modifications of the preferred embodiment, as well as other embodiments of the invention, will be obvious and suggested to those skilled in the art from the disclosure herein, whereby it will be distinctly understood that the foregoing descriptive matter is to be interpreted merely as illustrative of the present invention and not as a limitation thereof.

I claim:

1. A welder cable coupler on a welder housing or wire feeder for conveniently connecting a welder cable to said welding housing or wire feeder, said welder coupler having a coupling jacket which includes an electrical coupling cavity having a plurality of electrical connectors positioned therein and a coupling sleeve rotatably positioned at least partially about said coupling jacket, said coupling jacket sized and shaped to be at least partially telescopically received in a cable connection sleeve of said welder cable, said plurality of electrical connectors in said coupling cavity designed to be electrically connected to corresponding electrical connectors in said cable connection sleeve at least when said coupling jacket is partially telescopically received in said cable connection sleeve, said coupling sleeve including a gripping member and a joining cavity having at least one thread, said at least one thread in said joining cavity of said coupling sleeve being spaced from a receiving end of said joining cavity, said joining cavity designed to at least partially engage an outer threaded surface of said cable connection sleeve after a majority of said electrical coupling cavity is at least partially telescopically inserted in said cable connection sleeve, said gripping member designed to facilitate in the rotation of said coupling sleeve on said coupling jacket, said gripping member on said coupling sleeve including a plurality of nodes substantially symmetrically oriented on said coupling sleeve to form a generally star-shaped configuration.

2. The welder cable coupler as defined in claim 1, wherein at least a majority of said electrical coupling cavity extends outwardly from said receiving end of said joining cavity.

3. The welder cable coupler as defined in claim 1, wherein said receiving end of said joining cavity has a beveled surface designed to receive a front end of said cable connection sleeve.

4. The welder cable coupler as defined in claim 3, wherein at least a majority of said electrical coupling cavity extends outwardly from said receiving end of said joining cavity.

5. The welder cable coupler as defined in claim 1, wherein said coupling jacket includes an orientation guide designed to at least partially guide said coupling jacket in a certain orientation into said cable coupling sleeve.

6. The welder cable coupler as defined in claim 5, wherein said receiving end of said joining cavity has a beveled surface designed to receive a front end of said cable connection sleeve.

7. The welder cable coupler as defined in claim 6, wherein at least a majority of said electrical coupling cavity extends outwardly from said receiving end of said joining cavity.

8. The welder cable coupler as defined in claim 7, wherein said coupling jacket is substantially rigidly secured to a mounting plate that is designed to be secured to said welder housing or wire feeder, said mounting plate including a plate cavity designed to at least partially telescopically receive a rear portion of said coupling jacket.

9. The welder cable coupler as defined in claim 8, wherein said coupling sleeve is movable along a longitudinal axis of said coupling jacket, said coupling jacket including a retention member to limit movement of said coupling sleeve along a longitudinal axis of said coupling jacket.

10. The welder cable coupler as defined in claim 9, wherein said mounting plate includes an anti-rotation member that engages said coupling jacket when said coupling jacket is at least partially positioned in said plate cavity, said anti-rotation member inhibiting movement of said coupling jacket in said plate cavity.

11. A welder cable coupler on a welder housing or wire feeder for conveniently connecting a welder cable to said welding housing or wire feeder, said welder coupler having a coupling jacket which includes an electrical coupling cavity having a plurality of electrical connectors positioned therein and a coupling sleeve rotatably positioned at least partially about said coupling jacket, said coupling jacket sized and shaped to be at least partially telescopically received in a cable connection sleeve of said welder cable, said plurality of electrical connectors in said coupling cavity designed to be electrically connected to corresponding electrical connectors in said cable connection sleeve at least when said coupling jacket is partially telescopically received in said cable connection sleeve, said coupling sleeve including a gripping member and a joining cavity having at least one thread, said joining cavity designed to at least partially engage an outer threaded surface of said cable connection sleeve after a majority of said electrical coupling cavity is at least partially telescopically inserted in said cable connection sleeve, said gripping member designed to facilitate in the rotation of said coupling sleeve on said coupling jacket, said gripping member on said coupling sleeve including a plurality of nodes substantially symmetrically oriented on said coupling sleeve to form a generally star-shaped configuration, said coupling jacket being substantially rigidly secured to a mounting plate that is designed to be secured to said welder housing or wire feeder, said mounting plate including a plate cavity designed to at least partially telescopically receive a rear portion of said coupling jacket, said mounting plate including an anti-rotation member that engages said coupling jacket when said coupling jacket is at least partially positioned in said plate cavity, said anti-rotation member inhibiting movement of said coupling jacket in said plate cavity.

12. The welder cable coupler as defined in claim 11, wherein said coupling sleeve is movable along a longitudinal axis of said coupling jacket, said coupling jacket including a retention member to limit movement of said coupling sleeve along a longitudinal axis of said coupling jacket.

13. A welder cable coupler on a welder housing or wire feeder for conveniently connecting a welder cable to said welding housing or wire feeder comprising a coupler having coupling jacket which includes an electrical coupling cavity having a plurality of electrical connectors positioned therein and a coupling sleeve rotatably positioned at least partially about said coupling jacket, said coupling jacket designed to be at least partially telescopically received in a cable connection sleeve of said welder cable, said electrical connectors in said coupling cavity designed to be electrically connected to corresponding electrical connectors in said cable connection sleeve at least when said coupling jacket is partially telescopically received in said cable connection sleeve, said coupling sleeve including a joining cavity having a connection member designed to at least partially engage an outer surface of said cable connection sleeve after said electrical coupling cavity is at least partially telescopically inserted in said cable connection sleeve and said electrical connector in said coupling cavity is at least partially electrically connected to the corresponding electrical connector in said cable connection sleeve, said connection member being spaced from a receiving end of said joining cavity.

14. The welder cable coupler as defined in claim 13, wherein said connection member includes at least one thread.

15. The welder cable coupler as defined in claim 13, wherein said coupling sleeve is oriented on said coupling jacket to enable at least a majority of said electrical coupling cavity to be telescopically inserted in said cable connection sleeve prior to said connection member at least partially engaging said outer surface of said cable connection sleeve.

16. The welder cable coupler as defined in claim 13, wherein said coupling jacket includes an orientation guide designed to at least partially guide said coupling jacket in a certain orientation into said cable coupling sleeve.

17. The welder cable coupler as defined in claim 13, wherein said receiving end of said joining cavity has a beveled surface designed to receive a front end of said cable connection sleeve.

18. The welder cable coupler as defined in claim 13, wherein at least a majority of said coupling cavity extends outwardly from said receiving end of said joining cavity.

19. The welder cable coupler as defined in claim 13, wherein said coupling sleeve includes a gripping member to facilitate in the rotation of said coupling sleeve on said coupling jacket.

20. The welder cable coupler as defined in claim 19, wherein said gripping member on said coupling sleeve includes a plurality of nodes substantially symmetrically oriented on said coupling sleeve to form a generally star-shaped configuration.

21. The welder cable coupler as defined in claim 13, wherein said connection member includes at least one thread.

22. The welder cable coupler as defined in claim 21, wherein said coupling sleeve is oriented on said coupling jacket to enable at least a majority of said electrical coupling cavity to be telescopically inserted in said cable connection sleeve prior to said connection member at least partially engaging said outer surface of said cable connection sleeve.

23. The welder cable coupler as defined in claim 22, wherein said coupling jacket includes an orientation guide designed to at least partially guide said coupling jacket in a certain orientation into said cable coupling sleeve.

24. The welder cable coupler as defined in claim 23, wherein said coupling sleeve includes a gripping member to facilitate in the rotation of said coupling sleeve on said coupling jacket.

25. The welder cable coupler as defined in claim 24, wherein said receiving end of said joining cavity has a beveled surface designed to receive a front end of said cable connection sleeve.

26. The welder cable coupler as defined in claim 25, wherein at least a majority of said coupling cavity extends outwardly from said receiving end of said joining cavity.

27. The welder cable coupler as defined in claim 26, wherein said coupling jacket is substantially rigidly secured to a mounting plate that is designed to be secured to said welder housing or wire feeder, said mounting plate including a plate cavity designed to at least partially telescopically receive a rear portion of said coupling jacket.

28. The welder cable coupler as defined in claim 27, wherein said coupling sleeve is movable along a longitudinal axis of said coupling jacket, said coupling jacket including a retention member to limit movement of said coupling sleeve along a longitudinal axis of said coupling jacket.

29. The welder cable coupler as defined in claim 28, wherein said mounting plate includes an anti-rotation member that engages said coupling jacket when said coupling jacket is at least partially positioned in said plate cavity, said anti-rotation member inhibiting movement of said coupling jacket in said plate cavity.

30. A welder cable coupler on a welder housing or wire feeder for conveniently connecting a welder cable to said welding housing or wire feeder comprising a coupler having coupling jacket which includes an electrical coupling cavity having a plurality of electrical connectors positioned therein and a coupling sleeve rotatably positioned at least partially about said coupling jacket, said coupling jacket designed to be at least partially telescopically received in a cable connection sleeve of said welder cable, said coupling jacket being substantially rigidly secured to a mounting plate that is designed to be secured to said welder housing or wire feeder, said mounting plate including a plate cavity designed to at least partially telescopically receive a rear portion of said coupling jacket, said mounting plate includes an anti-rotation member that engages said coupling jacket when said coupling jacket is at least partially positioned in said plate cavity, said anti-rotation member inhibiting movement of said coupling jacket in said plate cavity, said electrical connectors in said coupling cavity designed to be electrically connected to corresponding electrical connectors in said cable connection sleeve at least when said coupling jacket is partially telescopically received in said cable connection sleeve, said coupling sleeve including a joining cavity having a connection member designed to at least partially engage an outer surface of said cable connection sleeve after said electrical coupling cavity is at least partially telescopically inserted in said cable connection sleeve and said electrical connector in said coupling cavity is at least partially electrically connected to the corresponding electrical connector in said cable connection sleeve.

31. The welder cable coupler as defined in claim 30, wherein said coupling sleeve is movable along a longitudinal axis of said coupling jacket, said coupling jacket including a retention member to limit movement of said coupling sleeve along a longitudinal axis of said coupling jacket.

32. A method of conveniently connecting a welder cable to a welding housing or wire feeder comprising:

a. providing a welder cable having a cable connection sleeve and a plurality of connectors at least partially positioned therein, said cable connection sleeve including a connection member;

b. providing a welder or wire feeder having a mounting plate secured thereto;

c. providing a coupler secured in a plate cavity of said mounting plate, said coupler having a coupling jacket that includes a plurality of connectors at least partially positioned therein and a coupling sleeve rotatably positioned at least partially about said coupling jacket, said coupling sleeve including a joining cavity having a connection member, said at least one connector of said cable connection sleeve and said at least one connector of said coupling jacket are electrical connectors, a receiving end of said joining cavity having a beveled surface designed to receive a front end of said cable connection sleeve, said connection member of said joining cavity positioned rearwardly of said beveled surface;

d. inserting said cable connection sleeve about said coupling jacket until a plurality of said connectors of said cable connection sleeve are at least partially connected to a plurality of said connectors of said coupling jacket;

e. moving said coupling sleeve axially along a longitudinal axis of said coupling jacket until said joining cavity in said coupling sleeve at least partially telescopically receives said cable connection sleeve and said connection member of said cable connection sleeve and said joining cavity are at least partially engaged; and, f. rotating said coupling sleeve until said connection member of said cable connection sleeve and said joining cavity are at least partially secured together.

33. The method as defined in claim 32, wherein at least a majority of said cable connection sleeve is inserted about said coupling jacket prior to said moving of said coupling sleeve to cause said joining cavity to at least partially telescopically receive said cable connection sleeve.

34. The method as defined in claim 32, wherein said connection member of said cable connection sleeve and said joining cavity includes at least one thread.

35. The method as defined in claim 32, wherein said coupling jacket includes an orientation guide to guide said coupling jacket a certain orientation relative to said cable coupling sleeve as said cable connection sleeve is at least partially inserted about said coupling jacket.

36. The method as defined in claim 32, wherein said coupling sleeve includes a gripping member to facilitate in the rotation of said coupling sleeve on said coupling jacket.

37. The method as defined in claim 32, wherein said coupling jacket is substantially rigidly secured to said mounting plate, said mounting plate including a plate cavity designed to at least partially telescopically receive a rear portion of said coupling jacket.

38. The method as defined in claim 32, wherein said coupling sleeve is movable along a longitudinal axis of said coupling jacket, said coupling jacket including a retention member to limit movement of said coupling sleeve along a longitudinal axis of said coupling jacket between said retention member and mounting plate.

39. The method as defined in claim 32, wherein said cable connection sleeve and said coupling jacket include a plurality of electrical connectors.

40. The method as defined in claim 39, wherein at least a majority of said cable connection sleeve is inserted about said coupling jacket prior to said moving of said coupling sleeve to cause said joining cavity to at least partially telescopically receive said cable connection sleeve.

41. The method as defined in claim 40, wherein said connection member of said cable connection sleeve and said joining cavity includes at least one thread.

42. The method as defined in claim 41, wherein said coupling jacket includes an orientation guide to guide said coupling jacket a certain orientation relative to said cable coupling sleeve as said cable connection sleeve is at least partially inserted about said coupling jacket.

43. The method as defined in claim 42, wherein said coupling sleeve includes a gripping member to facilitate in the rotation of said coupling sleeve on said coupling jacket.

44. The method as defined in claim 36, wherein said gripping member on said coupling sleeve includes a plurality of nodes substantially symmetrically oriented on said coupling sleeve to form a generally star-shaped configuration.

45. The method as defined in claim 43, wherein said coupling jacket is substantially rigidly secured to said mounting plate, said mounting plate including a plate cavity designed to at least partially telescopically receive a rear portion of said coupling jacket.

46. The method as defined in claim 45, wherein said coupling sleeve is movable along a longitudinal axis of said coupling jacket, said coupling jacket including a retention member to limit movement of said coupling sleeve along a longitudinal axis of said coupling jacket between said retention member and mounting plate.

47. The method as defined in claim 46, wherein said mounting plate includes an anti-rotation member that engages said coupling jacket to inhibit movement of said coupling jacket relative to said mounting plate.

48. The method as defined in claim 47, wherein said gripping member on said coupling sleeve includes a plurality of nodes substantially symmetrically oriented on said coupling sleeve to form a generally star-shaped configuration.

49. A method of conveniently connecting a welder cable to a welding housing or wire feeder comprising:

a. providing a welder cable having a cable connection sleeve and a plurality of connectors at least partially positioned therein, said cable connection sleeve including a connection member;

b. providing a welder or wire feeder having a mounting plate secured thereto;

c. providing a coupler secured in a plate cavity of said mounting plate, said coupler having a coupling jacket that includes a plurality of connectors at least partially positioned therein and a coupling sleeve rotatably positioned at least partially about said coupling jacket, said coupling sleeve including a joining cavity having a connection member, said at least one connector of said cable connection sleeve and said at least one connector of said coupling jacket are electrical connectors, said mounting plate including an anti-rotation member that engages said coupling jacket to inhibit movement of said coupling jacket relative to said mounting plate;

d. inserting said cable connection sleeve about said coupling jacket until a plurality of said connectors of said cable connection sleeve are at least partially connected to a plurality of said connectors of said coupling jacket;

e. moving said coupling sleeve axially along a longitudinal axis of said coupling jacket until said joining cavity in said coupling sleeve at least partially telescopically receives said cable connection sleeve and said connection member of said cable connection sleeve and said joining cavity are at least partially engaged; and, f. rotating said coupling sleeve until said connection member of said cable connection sleeve and said joining cavity are at least partially secured together.

* * * * *